US005383667A

United States Patent [19]

Sheely

[11] Patent Number: 5,383,667

[45] Date of Patent: Jan. 24, 1995

[54] GOLF GAME

[76] Inventor: Thomas Sheely, 501 Airport Cir., Bentonville, Ark. 72712

[21] Appl. No.: 975,718

[22] Filed: Nov. 13, 1992

[51] Int. Cl.[6] ..... A63B 63/02

[52] U.S. Cl. ..... 273/181 R; 273/35 R

[58] Field of Search ..... 273/181 R, 182 R, 181 C, 273/181 F, 181 K, 35 R, 183.1, 352, 176 H, 180, 177 B, 181 A

[56] References Cited

U.S. PATENT DOCUMENTS

| | | | |
|---|---|---|---|
| 1,221,803 | 4/1917 | Johnston | 273/181 R |
| 1,442,054 | 1/1923 | Dixon . | |
| 2,232,569 | 2/1941 | Johnson | 273/182 R |
| 2,301,767 | 11/1942 | WIllingham | 273/182 R |
| 2,936,179 | 5/1960 | Thurston . | |
| 2,937,875 | 5/1960 | Mason et al. | 273/35 R |
| 3,264,001 | 8/1966 | Urban . | |
| 3,490,769 | 1/1970 | Torbett | 273/181 R |
| 3,526,405 | 9/1970 | Morris | 273/181 R |
| 3,719,362 | 3/1973 | Blanchard | 273/182 R |
| 3,963,240 | 6/1976 | Tidwell | 273/183.1 |
| 4,281,834 | 8/1981 | Chavez | 273/182 R |
| 4,336,939 | 6/1982 | Krumlauf | 273/182 R X |
| 4,511,146 | 4/1985 | Windall . | |
| 4,734,020 | 5/1988 | Meurer | 273/182 R X |
| 4,927,160 | 5/1990 | Nichol et al. . | |

*Primary Examiner*—William E. Stoll
*Attorney, Agent, or Firm*—Stuart E. Beck

[57] ABSTRACT

A target for a golf course having a surface that is tilted toward the tee-off location so that it is visible from said tee-off location. The target includes a plurality of scoring regions on said surface. The regions are of different sizes with the smaller regions correspond to a fewer number of strokes while the larger regions correspond to a greater number of strokes. A golf tee location for a driving range that includes a target area spaced from said location having several teeing-off tees that are spaced laterally from each other. A golf course driving range having at least one fairway with both a golf tee location and at least one target. The golf tee location and the target are spaced from each other, a sufficient distance so that a golfer has to drive a golf ball to reach the target from the golf tee location. The target comprises a surface that is tilted generally toward the golf tee location so that it is visible from the golf tee location.

14 Claims, 2 Drawing Sheets

GOLF GAME

FIELD OF THE INVENTION

This invention relates to a golf game and more particularly to a golf game which simulates a fairway and green.

BACKGROUND OF THE INVENTION

The golf game of the present invention simulates the teeing off at several holes and driving toward the greens associated with those tees and the holes therein.

The golf game is advantageous in that it simulates actual golf play. Thus, a playing field is provided which has on it a plurality of areas that are comparable to fairways. Each fairway includes a teeing off location and a target. The target corresponds to the green and hole on an actual golf course.

On each of the fairways the targets are set at different distances from the teeing off location. Consequently as a player moves from fairway to fairway, as in a real game, he will encounter different degrees of difficulty in hitting the ball to the green because of the distance from the teeing off location to the target. Additionally at each of the teeing-off locations there are several tees so that a golfer will be required to adjust for the relative angle between the tee and the target.

The playing field is arranged so that several parties of golfers can move through the course, each playing their own game, just as in an actual golf game.

SUMMARY OF THE INVENTION

With the foregoing in mind the invention relates to a target for a golf course of the type having a tee-off location. The target includes a surface which is tilted generally toward the tee off location so that it is visible. The surface of the target includes a plurality of scoring regions. The regions are of different size so that the smaller regions correspond to a fewer number of strokes while the larger regions correspond to a greater number of stokes.

In addition the invention relates to a golf tee station for a driving range that includes a target area that is spaced from the golf tee location. The golf tee station includes a plurality of laterally spaced teeing-off tees.

In another aspect, the invention relates to a golf course driving range comprising at least one fairway having a golf tee station and a target. The target and the golf tee station are spaced from each other and the target is tilted so that it is visible from the golf tee station.

DETAILED DESCRIPTION OF THE INVENTION

Figure 1:
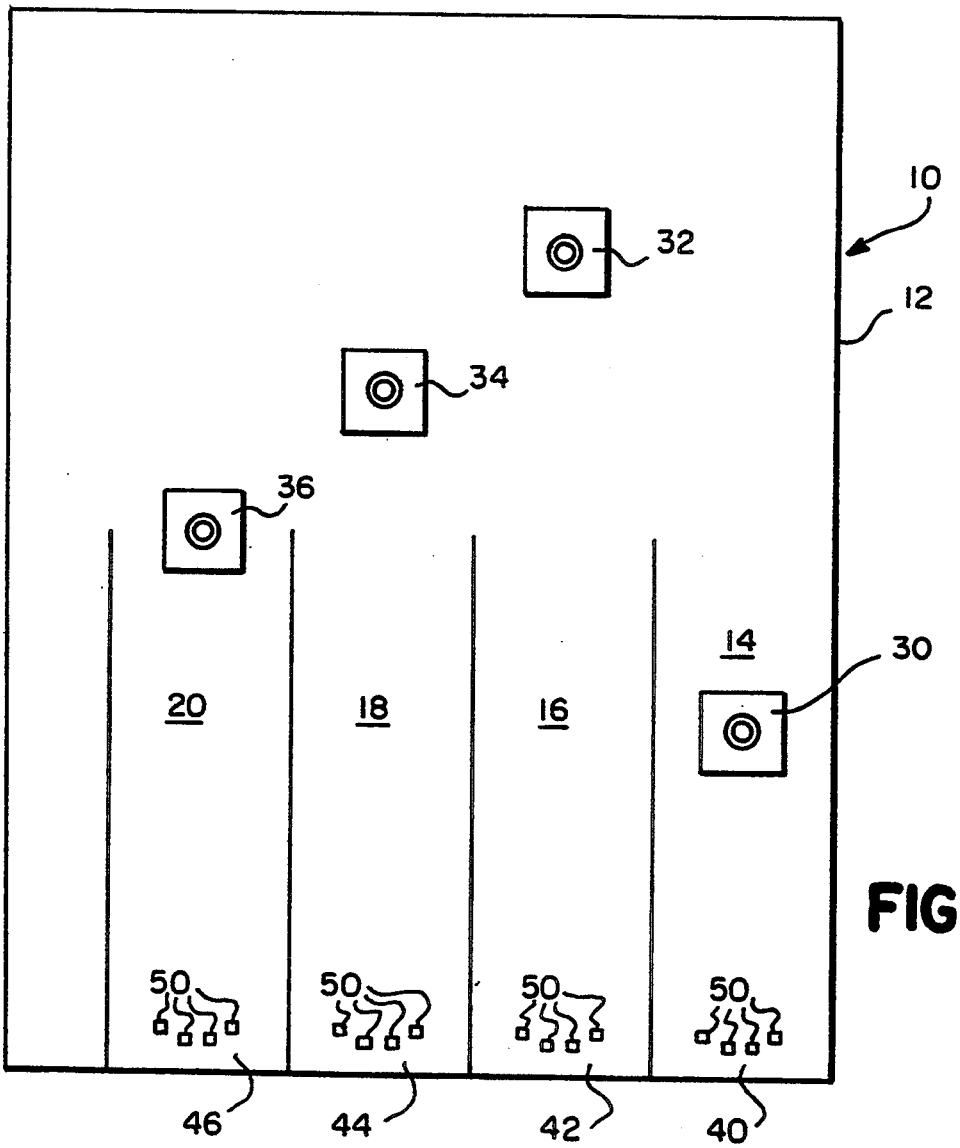
FIG. 1 is a plan view showing a golf course constructed in accordance with a presently preferred form of the invention.

The invention can best be understood by referring to the accompanying drawing where FIG. 1 shows a golf course 10 constructed in accordance with a presently preferred form of the invention.

As seen in FIG. 1 the golf course which is preferably defined by a boundary 12 such as a fence or the like includes a plurality of fairways 14, 16, 18 and 20.

Preferably each of the fairways is about 60 to 90 feet wide. They are disposed in side by side relation. Each fairway includes a target 30, 32, 34 and 36 and a tee off location 40, 42, 44 and 46.

Preferably the tee-off locations 40, 42, 44 and 46 are all at the same end of the golf course so that a golfer can move from one fairway to the next without interfering with the play of other golfers.

Figure 2:
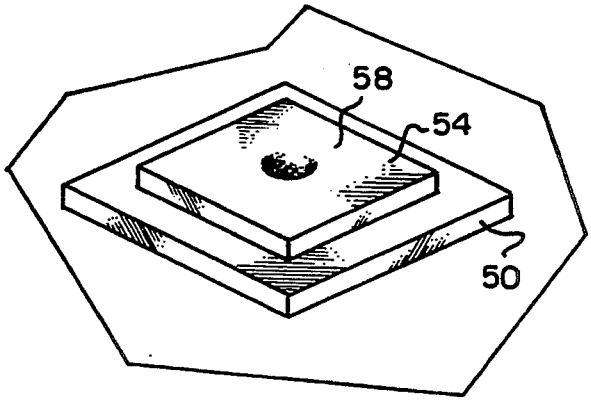
FIG. 2 is a perspective view of a portion of the golf course illustrated in FIG. 1.

As best seen in FIG. 2, a typical tee-off location 40 comprises four cement or asphalt pads 50 at one end of the fairway. Each pad 50 is about six feet square. A mat or rug 54 whose dimensions are about five feet by five feet is placed on each pad 50 and a tee 58 is supported by each mat 54. The pads 50 may be arranged in an arc at about 10 foot intervals with the outer most pads closer to the target than the inner-most mats. Each of the pads at each tee-off location may be identified by suitable indicia such as numbers, letters or names. At each of the other tee-off locations, the same identifying indicia are used, but in different order so that corresponding pads at different tee-off locations have different identifying indicia. Thus, on fairway 14 the pads 50 may be numbered "1", "2", "3", and "4". On fairway 16 the corresponding pads 50 may be numbered "2", "3", "4", and "1". On fairway 18 the corresponding pads 50 may be numbered "3", "4", "1", and "2". On fairway 20 the pads 50 may be numbered "4", "1", "2", and "3".

Figure 4:
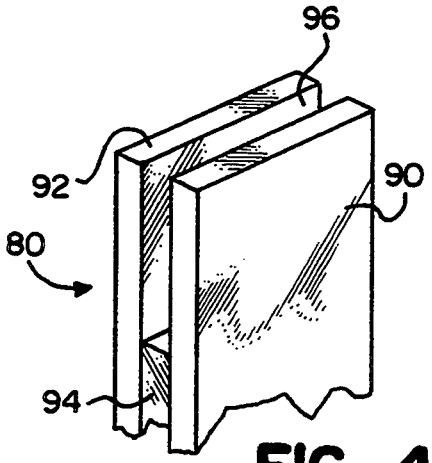
FIG. 4 is a detail of a portion of FIG. 3.
Figure 3:
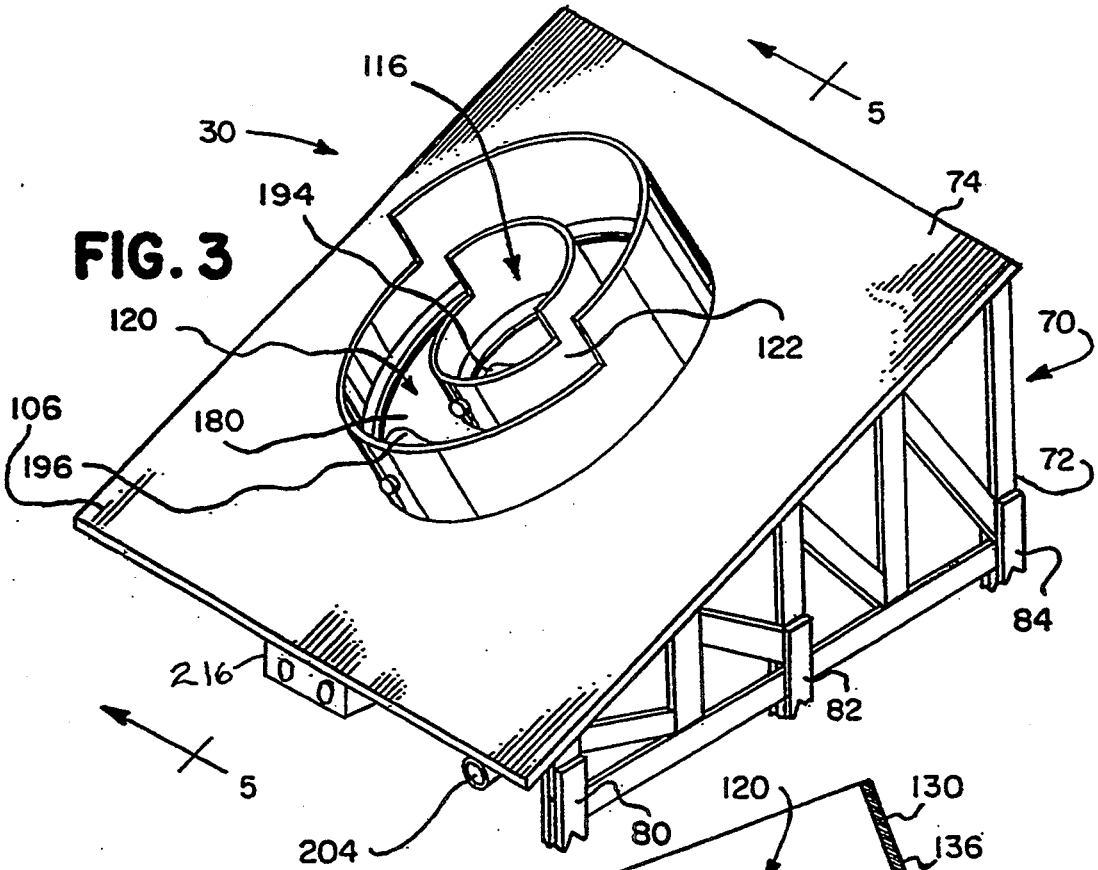
FIG. 3 is a perspective view of a target for the golf course illustrated in FIG. 1.
Figure 5:
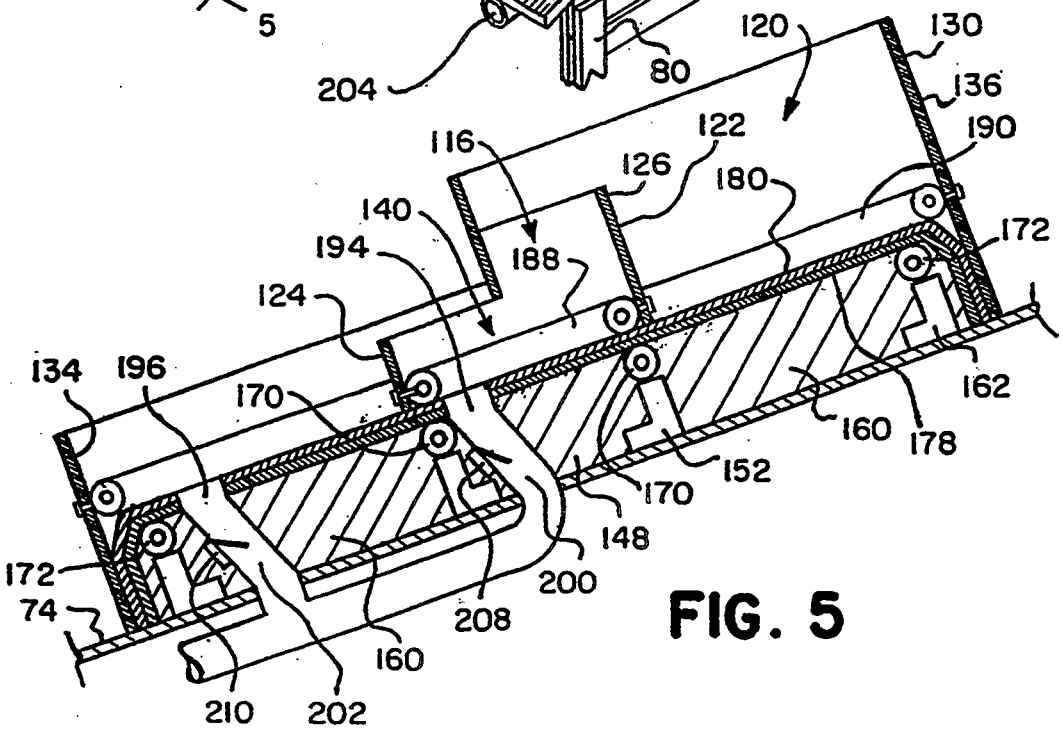
FIG. 5 is a section view taken along line 5—5 of FIG. 3.

A typical target 30 that is preferred for the golf game of the present invention is illustrated in FIGS. 3–5 as being supported by a truss 70 which is defined by a plurality of triangularly shaped frames 72 only one of which is shown.

The frames 72 are spaced in side-by-side parallel relation at regular intervals to support surface 74. Preferably, each frame 72 is constructed so that the surface 74 is tilted to about an angle of 15° from the horizontal. While the degree of tilting can be greater or less, it has been determined that this degree of tilting makes the target 30 readily visible from the teeing off location 40.

Each of the frames 72 is supported by three posts 80, 82 and 84. A typical post 80 is illustrated in FIG. 4. It comprises two outer planks 90 and 92 with a shorter plank 94 disposed between them so that a slot 96 is created. Three posts 80, 82 and 84 are imbedded in the ground for each frame 72 at the location where the target will be placed. The frames 72 then can be lowered into the slots 96 whereby they are supported. Preferably, the posts are made of treated wood so that they can withstand temperature changes and moisture and insects which are present in the soil.

The surface 74 of the target 30 may be comprised of a plurality of preferably wooden panels 106 which are supported on the truss. The frame 72 may be connected to each other by suitable wood beams at regular intervals. Typically, the panels 106 can be comprised of four foot by eight foot sections of plywood having their edges positioned over and supported by the frames and beams.

As illustrated in FIG. 3, the surface 74 of the target is preferably square. However, the targets may be round or rectangular or any other convenient shape to enhance interest and enthusiasm for the game.

In one preferred form of the invention, the surface 74 of the target 30 should be about 2,300 square feet. However, a suitable target can be made having an area of between 1,600 square feet and 3,600 square feet.

The size of the target and its distance from the golf tee-off location cooperate to make the game a test of skill and also useful as a practice range.

As best seen in FIGS. 3 and 5 the center portion of the target 30 comprises two scoring regions 116 and 120. The first scoring region 116 which may be in the center of the target is defined by a upstanding transparent annular separator 122 that may have a diameter of about four feet. The separator may be made of any suitable durable material such as plastic or wire mesh. The wire mesh is particularly advantageous since it is not visible at a distance, and because it offers little wind resistance. As is apparent from FIG. 5 the portion 124 of the separator closest to the golf tee-off location 40 is lower than the portion 126 which is further. Thus, a golf ball which lands in the region 116 defined by the separator 122 is unlikely to bounce backward out of the scoring region. The second scoring region 120 which may be coaxial with the first scoring region 116 is defined by a further separator 130 that may have a diameter of about 20 feet. In a similar fashion this separator 130 is also an upstanding transparent annular member with portion 134 closest to the golf tee-off location being lower than the portion 136 which is further.

Disposed within each of the scoring regions 116 and 120 is a layer of bounce absorbent material 140. As best seen in FIG. 5 in scoring region 116 the layer of bounce absorbent material 140 comprises an inner layer of glass fiber reinforced plastic 148 which is supported on the surface 74. The inner layer of fiberglass 148 is retained in position by annular angle 152.

In the second scoring region 120 the bounce absorbent material includes annulus 160 of fiberglass which is retained in position by annular angle 162.

Preferably, each of the scoring regions is defined by annular tubes 170 and 172 which are connected to the angles 152 and 162 respectively.

A layer of water resistant material 178 is placed over the tubes 170 and 172 fastened into position as by being tacked or adhered to the angles 152 and 162.

Overlying the layer of water resistant material 178 is a layer of bounce and sound absorbent material 180 such as indoor/outdoor carpeting. The layers 178 and 180 are retained in place by annular tubes 188 and 190. The aforementioned upright transparent plastic separators 122 and 130 are supported by the tubes 188 and 190 defining the respective scoring regions.

In the lower most-portion of each of the scoring regions openings 194 and 196 are formed in the various layers to permit a golf ball to pass. At the underside of the target conduits 200 and 202 are provided to conduct the golf balls that pass through the openings 194 and 196 through an opening 204 at the front of the target from which they are readily accessible.

As shown schematically in conduits 200 and 202, microswitches 208 and 210 are provided. Each of the microswitches closes when a golf ball rolls over it. This closes a circuit (not shown) of a well known type to energize an alarm 216 such as a flag, bell, gong, light or other suitable device. Since each of the microswitches 208 and 210 is in its own circuit, the alarm can be arranged to alert the golfer as to in which of the scoring regions 116 or 120 his ball landed.

The golf game can be created with just one fairway 14 or with several fairways 14, 16, 18 and 20 as illustrated in FIG. 1. A golfer can play individually or with a group. Up to four individuals or four groups can play at the same time to the target on a fairway. The individual or group would be assigned or would select one of the four tees from which to play. The individual or group would be assigned a particular numbered tee for the game. They will play the tee identified by that number in each of the fairways played. The group should play each fairway in order.

The number of strokes penalized will depend on where the golf ball lands. For example, if the ball lands in the first scoring region 116 no strokes are scored. If it lands in the second scoring region 120 one stroke is scored. The golfer will know in which of the two regions the ball has landed by noting the nature of the alarm.

It is not necessary to have a specific alarm for a ball which lands on surface 74 outside of the second scoring region 120. This is because the ball will be audible when it hits the wooden surface and bounces into the air where it will be readily visible. If the ball lands on the target in this area, two strokes, corresponding to par for that "hole," are scored. Finally, if the ball misses the target entirely, three strokes are scored.

Thus, it is apparent that the scoring parallels an actual game of golf in that the better players will score a lower number of strokes than the weaker players.

After all of the golfers have played the first fairway they then move to the other fairways 16, 18 and 20. Because in each fairway the location of the pad having a particular identifying indicia is different from its location in the other fairways, each golfer is required to tee off from a pad which is at a different angle relative to the target than that from which they teed off from on the first fairway 14. Accordingly, the golfer will have to adjust for the different relative angle between the pad and the target. In the second fairway 18 the target is at a distance from the tee-off location which is different than in the first fairway 14. Consequently, the golfers will have an opportunity to test their skills on targets at a different distance as well as at different angles. Preferably, targets 30 and 32 are about 70 and 160 yards respectively from their tee-off location.

As they progress thought the fairways 14, 16 18 and 20, golfers will be trying to hit targets which are at still different distances. Thus, as presently preferred in the first form of the invention, targets 34 and 36 are about 130 and 100 yards from their tee-off locations respectively.

Since there are four pads 50 at each tee-off locations each golfer will have an opportunity to tee off from each of four different locations relative to the target. In the game as presently contemplated, each player will hit nine balls from each tee for a total of 36 strokes. It has been found that for targets of the size described which are located at the distances selected, a golfer experiences the same degree of difficulty that would be experienced on an actual golf course. Thus, the golfer's score at the end of 36 balls is approximately that which he can expect to achieve on a regular golf course.

In another form of the invention there is only one fairway. The target includes an area of about 500 to 600 square feet and is about 40 yards from the tee-off location.

Thus, what has been described is a golf game which serves as a ready substitute for actually playing on a golf course. The golf game provides an opportunity to both test and develop driving skills since it includes a variety of targets at different locations from the tees and at the same time requires the golfers to address the target from different angles at the tee.

While the invention has been described with respect to a particular preferred embodiment, it is apparent that other forms and embodiments will be obvious to those skilled in the art in view of the foregoing description. Thus, the scope of the invention should not be limited by that description, but only by the claims appended hereto.

I claim:

1. A target for a golf course of the type having a tee-off location spaced at least about 50 yards from said target comprising a surface, means for tilting said surface generally toward said tee-off location so that said surface is visible from said tee-off location, and a plurality of scoring regions on said surface, said regions being separated from each other by separators, said separators being supported by said surface and extending upwardly from it a distance sufficient to contain a ball that falls into a scoring region, said separators being transparent so that the view of the target is not obstructed when observed from said tee-off location, and said regions are of different sizes so that said smaller regions correspond to a fewer number of strokes, and said larger regions correspond to a greater number of strokes.

2. A target as defined in claim 1 including means for detecting the presence of a golf ball in at least some of said regions, and alarm means connected to said detecting means to indicate to a golfer which region of the target if any has received the golf ball.

3. A target for a golf course of the type having a tee-off location spaced at least about 50 yards from said target comprising a surface, a truss for supporting said surface, said truss comprising a plurality of frames disposed in spaced parallel relation, each of said frames being supported by a plurality of support posts, each of said support posts being an elongated member, the lower portion of each of said support posts being for being embedded in the ground, and the other end of each of said support posts including means for engaging one of said frames, each of said frames being generally triangularly shaped so that said truss tilts said surface generally toward said tee-off location so that said surface is visible from said tee-off location, and a plurality of scoring regions on said surface, said regions being of different sizes so that said smaller regions correspond to a fewer number of strokes, and said larger regions correspond to a greater number of strokes.

4. A target as defined in claim 3 wherein some of said regions are comprised of bounce absorbent material so that when hit by a golf ball the impact is not audible and the golf ball does not bounce out of the region, and other of said regions not having bounce absorbent material so that the impact of the golf ball on said other regions is audible.

5. A target as defined in claim 3 wherein said surface is rectangular and includes an area of about 1600 to 3600 square feet.

6. A target as defined in claim 5 wherein the area of said surface is about 2300 square feet.

7. A target as defined in claim 3 wherein said surface is square and includes an area of about 1600 to 3600 square feet.

8. A target as defined in claim 7 wherein the area of said surface is about 2300 square feet.

9. A target as defined in claim 3 wherein said means for engaging said frame comprises a slot in which a portion of said frame is received.

10. A target as defined in claim 9 wherein said target surface comprises a plurality of wood panels, and said wood panels are supported by said frames.

11. A target as defined in claim 10 wherein a portion of said surface is comprised of bounce absorbent material.

12. A target for a golf course of the type having a tee-off location spaced at least about 50 yards from said target comprising a surface, means for tilting said surface generally toward said tee-off location so that said surface is visible from said tee-off location, a plurality of scoring regions on said surface, said regions being of different sizes so that said smaller regions correspond to a fewer number of strokes, and said larger regions correspond to a greater number of strokes, at least one of said regions including a perimeter and a layer of bounce absorbent material, said bounce absorbent material including a layer of glass fiber reinforced plastic and a layer of carpet, means mounted on said surface for supporting said bounce absorbent material, and said at least one region including an upwardly extending separator extending substantially around said perimeter.

13. A target as defined in claim 12 wherein said bounce absorbent material includes a layer of water repellant material disposed between said layers of glass fiber reinforced plastic and carpet like material.

14. A target for a golf course of the type having a tee-off location spaced at least about 50 yards from said target comprising a surface, means for tilting said surface generally toward said tee-off location so that said surface is visible from said tee-off location, a plurality of scoring regions on said surface, said regions being of different sizes so that said smaller regions correspond to a fewer number of strokes, and said larger regions correspond to a greater number of strokes, at least one of said regions including a perimeter and a layer of bounce absorbent material, means mounted on said surface for supporting said bounce absorbent material, and said at least one region including an upwardly extending separator extending substantially around said perimeter, said separator being transparent, and the part of said separator nearer the tee-off location is lower than the rest of said separator.

* * * * *